US006207917B1

(12) United States Patent
Lehmann et al.

(10) Patent No.: US 6,207,917 B1
(45) Date of Patent: Mar. 27, 2001

(54) COMPRESSED GAS POWER SWITCH

(75) Inventors: Volker Lehmann, Treuenbrietzen; Friedrich Löbner, Berlin, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/402,101

(22) PCT Filed: Mar. 27, 1998

(86) PCT No.: PCT/DE98/00921

§ 371 Date: Dec. 12, 1999

§ 102(e) Date: Dec. 12, 1999

(87) PCT Pub. No.: WO98/43265

PCT Pub. Date: Oct. 1, 1998

(30) Foreign Application Priority Data

Mar. 27, 1997 (DE) ..... 297 06 202 U

(51) Int. Cl.[7] ..... H01H 33/70

(52) U.S. Cl. ..... 218/43; 218/51; 218/154

(58) Field of Search ..... 218/43, 45, 46, 218/51, 52, 53, 54, 57, 59, 60, 61, 62, 63, 64, 65, 118, 120, 154

(56) References Cited

U.S. PATENT DOCUMENTS 5,723,840 * 3/1998 Bojic et al. ..... 218/60

FOREIGN PATENT DOCUMENTS

| | | |
|---|---|---|
| 574 162 | 3/1976 | (CH) . |
| 25 32 088 | 5/1976 | (DE) . |
| 26 18 087 | 10/1977 | (DE) . |
| 28 44 323 | 6/1979 | (DE) . |
| 30 12 964 | 10/1980 | (DE) . |
| 31 32 825 | 1/1983 | (DE) . |
| 33 15 622 | 12/1983 | (DE) . |
| 38 33 564 | 6/1989 | (DE) . |
| 195 47 522 | 1/1997 | (DE) . |
| 0 436 951 | 7/1991 | (EP) . |
| 2 011 718 | 7/1979 | (GB) . |

* cited by examiner

*Primary Examiner*—Lincoln Donovan
(74) *Attorney, Agent, or Firm*—Kenyon & Kenyon

(57) ABSTRACT

A compressed gas-blast is described having a first, actuatable arcing contact, a second, stationary arcing contact, a rated current path running concentrically to the contacts, as well as having a compression device, at least the first, actuatable arcing contact being supported by a switching tube. A discharge volume provided at the outlet of the switching tube is separated from an intake area by a separating wall, the discharge volume is connected to the low-pressure chamber via discharge openings.

7 Claims, 1 Drawing Sheet

COMPRESSED GAS POWER SWITCH

FIELD OF THE INVENTION

The present invention concerns a compressed gas-blast circuit-breaker having a first, actuatable arcing contact, a second stationary arcing contact, a rated current path, running concentrically with regard to the arcing contacts, the rated (nominal) current path having a first, actuatable rated current contact and a stationary rated current contact, as well as having a compression device which can be connected via a fill-up valve to a low-pressure chamber arranged radially outside of the rated current path. At least the first, actuatable arcing contact has an annular configuration and is supported by a switching tube, through whose outlet switching gases resulting from the breaking operation arrive in a discharge volume. The discharge volume is connected to the low-pressure chamber via discharge openings provided radially with respect to the switching tube.

BACKGROUND INFORMATION

A compressed gas-blast circuit-breaker of this type, regarding its contact arrangement and configuration, is described in, for example, German Patent No. 25 32 088. In this circuit breaker the first, actuatable arcing contact has an annular configuration and is supported by a switching tube through which switching gases resulting from the breaking operation arrive in a discharge volume, which is a low-pressure chamber. In this context, the contact arrangement has a compression device assigned to it, which can be connected to the discharge volume via a fill-up valve, as is also described in German Patent No. 26 18 087.

Irrespective of how compressed gas-blast circuit-breakers of this type are configured, i.e., even if the arcing contacts have a heating space assigned to them that is connected to the compression device via a non-return (stop) valve (a compressed gas-blast circuit-breaker of this type, for example, is described in German Patent 38 33 564), the flow of switching gases resulting from the breaking operation through the switching tube supporting the first, actuatable arcing contact into the discharge volume is always associated with a disadvantage affecting the breaking capacity of the compressed gas-blast circuit-breaker. This is true particularly because in response to a high-speed re-closing, it is unavoidable that the non-ionized quenching gas present in the fill-up valve mixes with the switching gas in the discharge volume contaminated by decomposition products and by vaporized materials.

SUMMARY

An object of the present invention is to provide a compressed gas-blast circuit-breaker in which, in response to a high-speed reclosing, the non-ionized quenching gas, present in the fill-up valve of the compression device and necessary for the subsequent breaking operation, is not polluted by the ionized and contaminated switching gas resulting from a breaking operation.

This objective is achieved by providing for an intake (suction) area between the cylinder base of the compression volume receiving the fill-up valve and the discharge volume, the intake area being spatially separated from the latter, and being connected to the low-pressure chamber via openings provided radially in the rated current path which runs concentrically with respect to the arcing contacts.

In this context, the additionally created intake area is spatially separated from the discharge volume by partitioning the latter from the intake area by a separating wall which is fixedly joined to the inner wall of the rated current path, configured particularly as a stationary compression cylinder. It is advantageous to configure the separating wall as a cowl (cover), which in its cylindrical area can be connected to the inner wall of the rated current path using a welding, soldering or adhesive connection.

If a high-speed re-closing occurs with a compressed gas-blast circuit-breaker configured in this way, the non-ionized quenching gas that is present in the fill-up valve of the compression device and is necessary for the subsequent breaking operation is made available to the compression device via the intake area without being polluted in the process by the ionized and contaminated quenching gas resulting from the breaking operation. Instead, the ionized quenching gas arrives in a discharge volume that is spatially separated from the intake area, before it is fed to the low-pressure chamber.

As a result of the fact, moreover, that in this compressed gas-blast circuit-breaker, the rated current path, in the area of the discharge openings assigned to the discharge volume and provided radially with respect to the switching tube, is surrounded at a distance from the openings by a baffle, it is at the same time achieved that the polluted quenching gas is additionally swirled and, in particular, does not directly encounter the interior wall of the housing. The quenching gas resulting from a breaking operation, however, is temporally delayed with respect to the initiation of the filling operation of the compression device and is fed, in response to a high-speed re-closing, via the intake area to the low-pressure chamber as de-ionized quenching gas, which then is available for further use after being mixed together with the cold quenching gas located here.

BRIEF DESCRIPTION OF THE DRAWING

The FIGURE shows a partial view of a compressed gas-blast circuit breaker according to the present invention.

DETAILED DESCRIPTION

Figure 1:
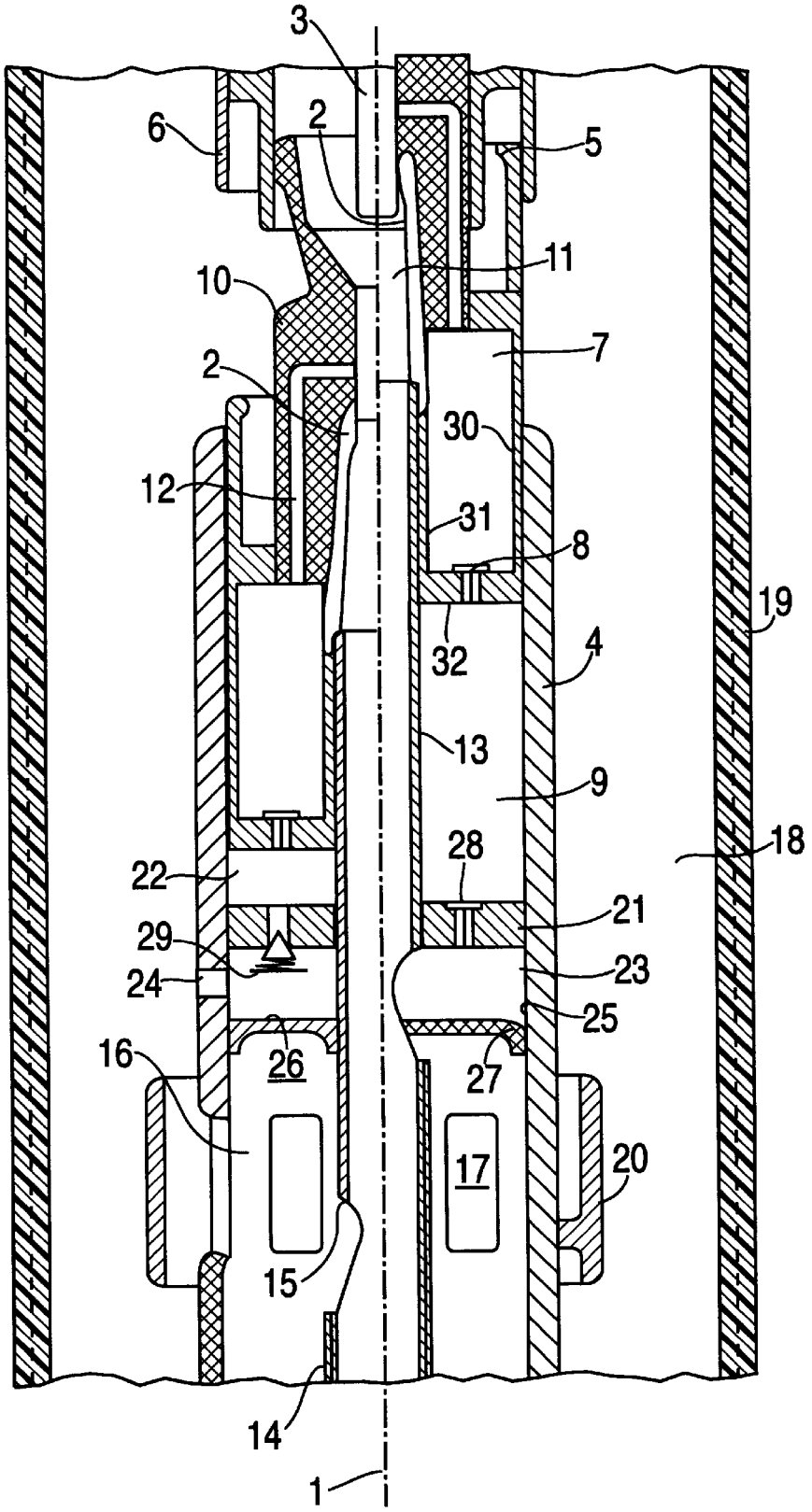

The compressed gas-blast circuit-breaker according to the present invention is illustrated in the FIGURE. In this FIGURE, the circuit-breaker is shown in relation to switch axis 1, half in the closed position and half in the open position. That is, the left side of the axis 1 shows the movable switch parts in the switch-off position; the right side of the; axis 1 shows the moveable switch parts in the on position. The moveable switch parts include the switching tube 12 having a movable arcing contact 2, the movable rated current contact 5, and the insulating nozzle body 10. In this context, the compressed gas-blast circuit-breaker is includes a first, actuatable arcing contact 2, a second, stationary arcing contact 3, a rated current path 4, running concentrically to the contacts and having a first, actuatable rated current contact 5. In addition, provision is made for a stationary rated current contact 6 as well as for a heating chamber 7 partially surrounding first, actuatable arcing contact 2. The heating chamber is connected via a non-return valve 8 to a compression device 9. The first, actuatable arcing contact 2 is connected to an insulating nozzle body 10, which has a gas duct 12 that can connect arcing chamber 11 to heating chamber 7 after the initiation of a breaking operation, the gas duct discharging into arcing chamber 11. The arcing contact is configured as a tulip contact and is supported by a switching tube 13, which is connected to switch rod 14.

The FIGURE further shows a external cylinder wall 30, an interior cylinder wall 31, and a base area 32. The parts (i.e., 30, 31 and 32) form a piston that can be moved in a cylinder formed by the rated current path 4, the switching tube 13 and the cylinder base 21.

As can further be seen from the FIGURE, after the separation of arcing contacts 2,3 in a breaking operation, outlet 15, formed by a radial opening of switching tube 13, is located in a discharge volume 16, so that the quenching gas resulting from a breaking operation, including the at least partially cooled quenching gas, flowing back in the last phase of a breaking operation from heating chamber 7 via gas duct 12 into arcing chamber 11, arrives via switching tube 13 into discharge volume 16. This quenching gas is fed via discharge openings 17 within rated current path 4 to low-pressure chamber 18 arranged radially outside rated current path 4. In order that this quenching gas, as ionized quenching gas, be swirled before being fed into low-pressure chamber 18, which is bordered at its outer periphery by an insulating body 19, rated current path 4 in the area of discharge openings 17 is surrounded by a baffle 20, which is arranged with clearance with respect to discharge openings 17.

The FIGURE also shows that an intake area 23 immediately adjoins cylinder base 21 of compression volume 22 of compression device 9, the intake area being also connected to low-pressure chamber 18 via openings 24 radially provided in rated current path 4. In this context, intake area 23 is spatially partitioned off from discharge volume 16 by a partition wall 26 fixedly connected to inner wall 25 of rated current path 4, the partition wall, configured as a cowl, being connected in a gas-tight manner at its cylindrical area 27 to inner wall 25 of rated current path 4.

If, after a breaking operation, a high-speed re-closing should take place using this compressed gas-blast circuit-breaker, then directly upon the initiation of the closing operation after the opening of fill-up valve 28 provided in cylinder base 21 (cylinder base 21 also has pressure relief valve 29) non-ionized quenching gas is fed via intake area 23 to compression volume 22 of compression device 9 from low-pressure chamber 18. Although at this time point, there is still at least partially ionized quenching gas in discharge volume 16 resulting from the breaking operation, this does not influence the non-ionized quenching gas fed to compression volume 22 via intake area 23. However this means that the compressed gas-blast circuit-breaker in response to a high-speed re-closing, is also distinguished by a breaking performance of undiminished quality.

What is claimed is:

1. A compressed gas-blast circuit-breaker, comprising:

an actuatable arcing contact having an annular configuration;

a stationary arcing contact;

a rated current path concentric with the actuatable arcing contact and the stationary arcing contact, the rated current path including an actuatable rated current contact, and a stationary rated current contact, intake area openings being provided radially in the rated current path and concentrically with the actuatable arcing contact and the stationary arcing contact;

a compression device connectable via a fill-up valve to a low-pressure chamber arranged radially outside of the rated current path, the compression device including a cylinder base accommodating the fill-up valve; and a switching tube supporting the first actuatable arcing contact, the switching tube having an outlet through which switching gases resulting from a breaking operation arrive in a discharge volume, the discharge volume being connected to the low-pressure chamber via discharge openings provided radially with respect to the switching tube, an intake area being provided between the cylinder base of the compression device and the discharge volume, the intake area being separated spatially from the discharge volume and connected to the low-pressure chamber via the intake area openings in the rated current path.

2. The compressed gas-blast circuit-breaker according to claim 1, further comprising:

a separating wall partitioning the discharge volume from the intake area, the separating wall being fixedly connected to an inner wall of the rated current path.

3. The compressed gas-blast circuit-breaker according to claim 2, wherein the separating wall is configured as a cowl.

4. The compressed gas-blast circuit-breaker according to claim 3, wherein the separating wall includes a cylindrical area connected to the inner wall of the rated current path using one of a welded connection, solder, and an adhesive.

5. The compressed gas-blast circuit-breaker according to claim 4, wherein the discharge openings are surrounded by a baffle at a distance from the discharge openings.

6. The compressed gas-blast circuit-breaker according to claim 1, wherein the intake area and the discharge volume are sealed from each other in a gas-tight manner.

7. The compressed gas-blast circuit-breaker according to claim 2, wherein the separating wall separates the intake area and the discharge volume in a gas-tight manner.

* * * * *